US009947214B2

(12) United States Patent
Shimizu et al.

(10) Patent No.: US 9,947,214 B2
(45) Date of Patent: Apr. 17, 2018

(54) AUTHENTICATION APPARATUS, AUTHENTICATION METHOD, AUTHENTICATION SYSTEM, AND CONTAINER SYSTEM

(71) Applicants: Sony Corporation, Tokyo (JP); Sony Computer Entertainment Inc., Tokyo (JP)

(72) Inventors: Kohei Shimizu, Tokyo (JP); Hideo Niikura, Tokyo (JP); Takayuki Hirabayashi, Tokyo (JP); Hidetoshi Kabasawa, Tokyo (JP); Masakazu Yajima, Tokyo (JP); Shinichi Honda, Tokyo (JP)

(73) Assignees: Sony Corporation, Tokyo (JP); Sony Interactive Entertainment Inc., Tokyo (JP)

( * ) Notice: Subject to any disclaimer, the term of this patent is extended or adjusted under 35 U.S.C. 154(b) by 208 days.

(21) Appl. No.: 13/793,590

(22) Filed: Mar. 11, 2013

(65) Prior Publication Data

US 2013/0241692 A1 Sep. 19, 2013

(30) Foreign Application Priority Data

Mar. 14, 2012 (JP) ..... 2012-056856

(51) Int. Cl.
*G08C 19/02* (2006.01)
*A61J 1/14* (2006.01)

(52) U.S. Cl.
CPC ..... *G08C 19/02* (2013.01); *A61J 1/1437* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,300,875 | A * | 4/1994 | Tuttle | H04M 1/0262 320/138 |
| 6,577,238 | B1 * | 6/2003 | Whitesmith | G01S 13/878 340/10.1 |
| 2002/0044595 | A1 * | 4/2002 | Friedrich | 375/219 |
| 2006/0088166 | A1 * | 4/2006 | Karusawa | 380/277 |
| 2006/0095344 | A1 * | 5/2006 | Nakfoor | G06F 21/33 705/26.1 |
| 2006/0214770 | A1 * | 9/2006 | Capouch et al. | 340/5.73 |

(Continued)

FOREIGN PATENT DOCUMENTS

| | | |
|---|---|---|
| JP | 2002-262147 | 9/2002 |
| JP | 2005-118532 | 5/2005 |

(Continued)

OTHER PUBLICATIONS

Office Action issued in JP Application 2012056856, dated Dec. 8, 2016 (4 pages).

(Continued)

*Primary Examiner* — Joseph Feild
*Assistant Examiner* — Cal Eustaquio
(74) *Attorney, Agent, or Firm* — K&L Gates LLP

(57) ABSTRACT

An authentication apparatus includes an authentication unit configured to perform authentication processing according to power generation information from a power generation unit configured to generate electric power from ambient energy.

11 Claims, 17 Drawing Sheets

(56) References Cited

U.S. PATENT DOCUMENTS

| | | | | |
|---|---|---|---|---|
| 2006/0276742 | A1* | 12/2006 | Matsumura | A61N 1/0428 604/20 |
| 2007/0030119 | A1* | 2/2007 | Ono et al. | 340/5.61 |
| 2009/0238772 | A1* | 9/2009 | Vaishnaw | C12N 15/1131 424/46 |
| 2009/0267740 | A1* | 10/2009 | Pizzuto | G06Q 10/087 340/10.1 |
| 2009/0322531 | A1* | 12/2009 | Estevez | E05B 47/0009 340/572.1 |

FOREIGN PATENT DOCUMENTS

| | | | |
|---|---|---|---|
| JP | 2008-138515 | A | 6/2008 |
| JP | 2009-112324 | | 5/2009 |
| JP | 2009-228302 | A | 10/2009 |
| JP | 2010-512944 | | 4/2010 |
| JP | 2011-221717 | | 11/2011 |

OTHER PUBLICATIONS

Japanese Office Action dated Feb. 21, 2017 in corresponding Japanese application No. 2012-056856 (4 pages).
Japanese Office Action issued in corresponding Japanese application No. 2012-056856 (7 pages).

* cited by examiner

AUTHENTICATION APPARATUS, AUTHENTICATION METHOD, AUTHENTICATION SYSTEM, AND CONTAINER SYSTEM

CROSS REFERENCES TO RELATED APPLICATIONS

The present application claims priority to Japanese Priority Patent Application JP 2012-056856 filed in the Japan Patent Office on Mar. 14, 2012, the entire content of which is hereby incorporated by reference.

BACKGROUND

The present disclosure relates to an authentication apparatus, an authentication method, an authentication system, and a container system that, for example, perform an authentication according to power generation information from a power generation unit.

When a user takes medicine, it is necessary to correctly identify a medicine and take an appropriate dose of medicine at appropriate timing. In addition, it is desirable to store the fact that the user has taken medicine and not to forget to take medicine. Japanese Patent Application Laid-open No. 2009-112324 describes a medication apparatus that records information on a medicine. In general, medicines are in a powder or capsule form, and hence there is a fear that accidental ingestion particularly by a child may occur. In order to prevent the accidental ingestion, as schematically shown in FIG. 1, there has been proposed, for example, a container bottle 1 for medicines with a cap portion 2. The container bottle 1 can be opened only by holding and rotating the cap portion 2. The function of the container bottle shown in FIG. 1 is called a childproof function or the like.

SUMMARY

The container bottle shown in FIG. 1 exerts a certain effect for preventing the accidental ingestion of medicine by a child. However, there is a problem in that it is difficult for persons who have difficulties in moving hands to open the container bottle. In addition, for preventing the accidental ingestion, it is desirable to give information on contents of the container bottle.

Therefore, there is a need for providing an authentication apparatus, an authentication method, an authentication system, and a container system that perform an authentication without complicated operations and allow a container to be opened if the authentication is successful.

According to an embodiment of the present disclosure, there is provided, for example, an authentication apparatus including an authentication unit configured to perform authentication processing according to power generation information from a power generation unit configured to generate electric power from ambient energy.

According to another embodiment of the present disclosure, there is provided, for example, an authentication method for an authentication apparatus configured to perform authentication processing according to power generation information from a power generation unit configured to generate electric power from ambient energy.

According to still another embodiment of the present disclosure, there is provided, for example, an authentication system including: a power generation unit configured to generate electric power from ambient energy; and an authentication unit configured to perform authentication processing according to power generation information from the power generation unit.

According to still another embodiment of the present disclosure, there is provided, for example, a container system including: a container unit configured to contain a predetermined object; and an authentication unit configured to perform authentication processing according to power generation information from a power generation unit.

According to at least one embodiment, it is possible to perform an authentication according to power generation information of a power generation unit and allow a container to be opened if the authentication is successful.

These and other objects, features and advantages of the present disclosure will become more apparent in light of the following detailed description of best mode embodiments thereof, as illustrated in the accompanying drawings.

Additional features and advantages are described herein, and will be apparent from the following Detailed Description and the figures.

DETAILED DESCRIPTION

Hereinafter, embodiments of the present disclosure will be described with reference to the drawings. Note that descriptions will be made in the following order.

1. First Embodiment
2. Second Embodiment
3. Third Embodiment

4. Fourth Embodiment

5. Modified Examples

Note that embodiments and modified examples to be described in the following are favorable and specific examples of the present disclosure and contents of the present disclosure are not limited to those embodiments and modified examples.

A power generation unit in the present disclosure generates electric power from ambient energy. The power generation unit generates electric power using, for example, light, heat, vibrations, radio waves, differences in temperature, or differences in ion concentration. Those types of energy are not limited to exist in the natural world. For example, heat generated by motions or a body of a user may be used. Heat generated by a moving body such as a vehicle may be used. Electromagnetic waves generated by an electronic apparatus of the user or the moving body.

1. First Embodiment

Outline of Medicine Bottle

First, a first embodiment will be described. In the first embodiment, the present disclosure is applied to a medicine bottle that contains medicines.

Figure 1:
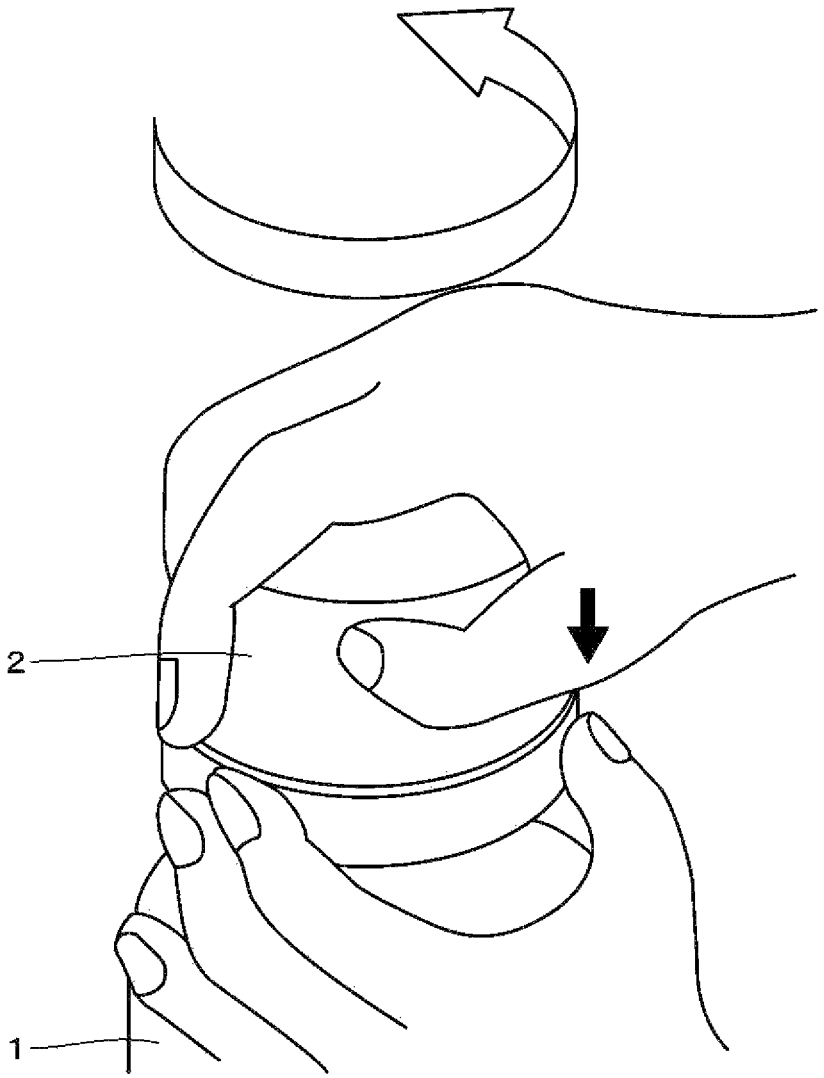
FIG. 1 is a view for explaining a childproof function.
Figure 2:
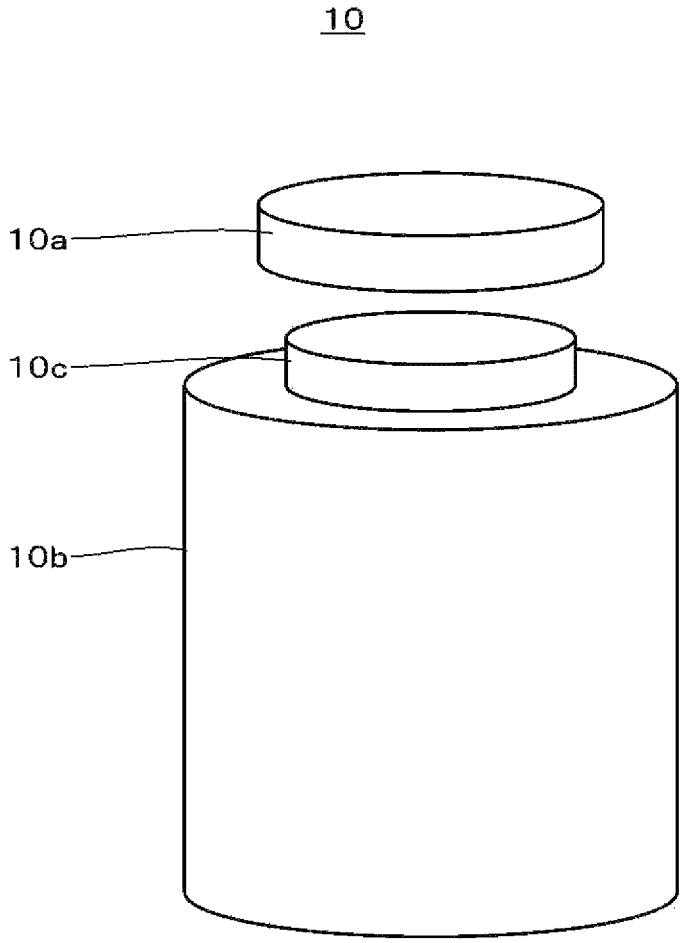
FIG. 2 is a view showing an exemplary outer appearance of a medicine bottle.

FIG. 2 is an exemplary outer appearance of a medicine bottle in the first embodiment. A medicine bottle 10 includes, for example, a cap portion 10*a* and a container unit 10*b* in which medicines are to be contained. The medicines to be contained in the container unit 10*b* are in the form of capsule or powder, for example. In the container unit 10*b*, a cap-mounting portion 10*c* is formed. The cap portion 10*a* is fixed to the cap-mounting portion 10*c* by a rotation.

In a state in which the cap portion 10*a* is fixed to the cap-mounting portion 10*c*, locking is performed (not shown) so that the cap portion 10*a* is not allowed to be removed. Although will be described later in detail, if the authentication is successful, unlocking is performed and the cap portion 10*a* is allowed to be removed. For example, if the cap portion 10*a* is rotated a predetermined number of times, the authentication is successful. The predetermined number is, for example, three. Of course, the predetermined number may be changed. Information on a rotating direction, for example, three rotations to the right and one rotation to the left may also be used. Information on rotation speed may also be used.

Figure 3:
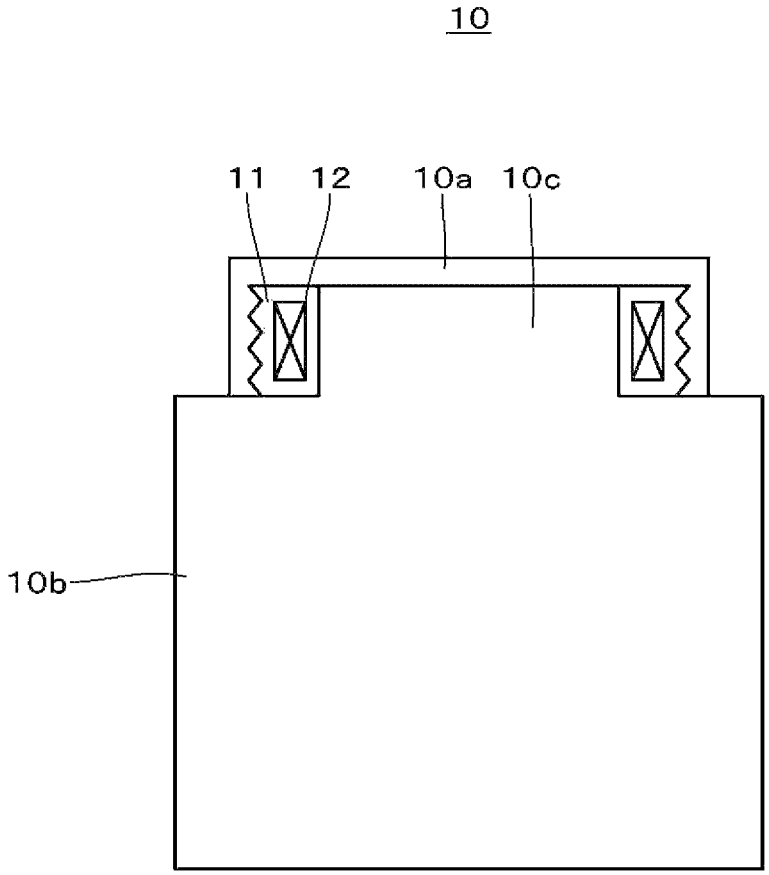
FIG. 3 is a view showing an exemplary configuration of the medicine bottle.

FIG. 3 shows an exemplary cross-section of the medicine bottle 10. Around the cap-mounting portion 10*c*, a bobbin 11 is formed. The bobbin 11 houses a coil 12. The cap portion 10*a* is rotated by an engagement between a groove of the cap portion 10*a* and a groove of the cap-mounting portion 10*c*.

Figure 4:
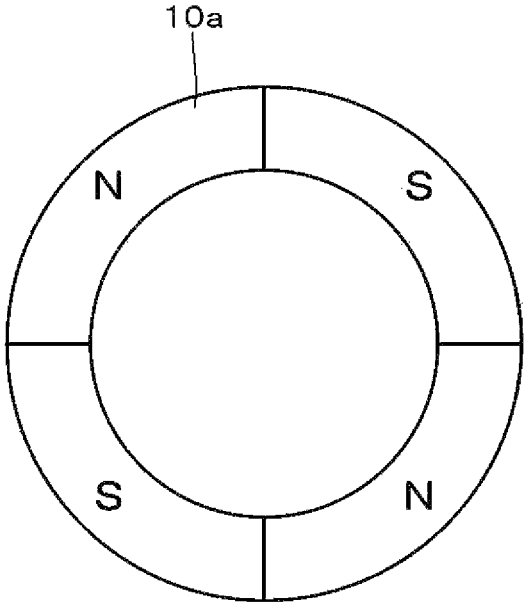
FIG. 4 is a view for explaining a magnetized cap portion by way of example.

The cap portion 10*a* is magnetized. FIG. 4 shows the magnetized cap portion 10*a* by way of example. For example, the cap portion 10*a* is divided into four almost-equal parts, which are alternately magnetized to the north pole and the south pole. Of course, the cap portion 10*a* shown in FIG. 4 is merely one example and the present disclosure is not limited thereto. For example, the cap portion 10*a* is divided into eight parts, which are alternately magnetized to the north pole and the south pole. By rotating the cap portion 10*a*, a relative position relationship between the cap portion 10*a* and the coil 12 is changed. Due to the change of the position relationship, electromotive force is generated and electric power is generated.

Configuration of Authentication Apparatus

Figure 5:
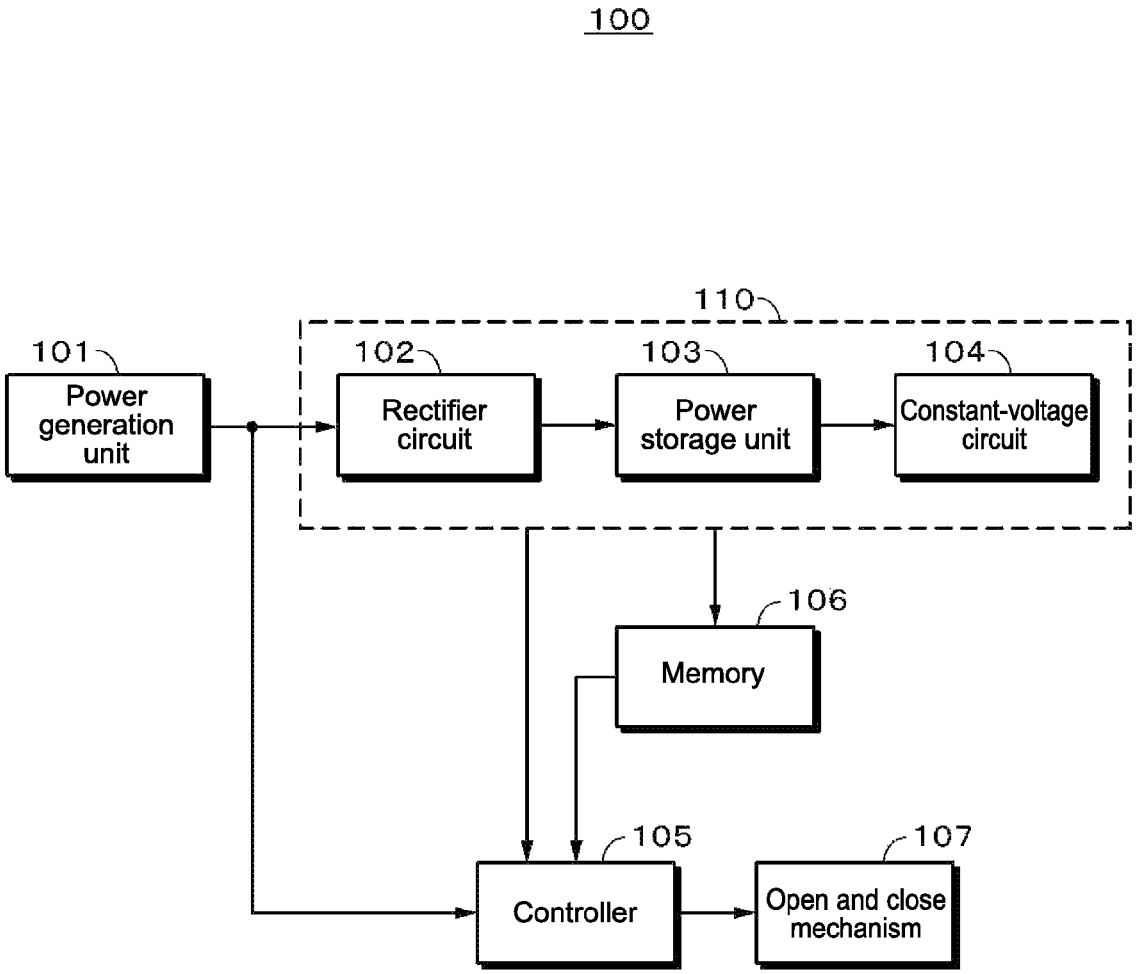
FIG. 5 is a view showing an exemplary configuration of an authentication apparatus according to a first embodiment.

The medicine bottle 10 includes an authentication apparatus. FIG. 5 shows an exemplary configuration of an authentication apparatus 100 of the medicine bottle 10. The authentication apparatus 100 includes a power generation unit 101, a rectifier circuit 102, a power storage unit 103, a constant-voltage circuit 104, a controller 105, a memory 106, and an open and close mechanism 107. For example, the rectifier circuit 102, the power storage unit 103, and the constant-voltage circuit 104 constitute a power-supply unit 110.

The power generation unit 101 includes, for example, the cap portion 10*a*, which is a magnetic body, and the coil 12. The power generation unit 101 may generate electric power in a different manner. For example, part of a peripheral surface of the medicine bottle 10 may be provided with a piezoelectric element made of a piezoelectric material. By pressing the position of the piezoelectric element, electric power may be generated and power generation information may be obtained.

Examples of the piezoelectric material may include lead zirconate titanate (PZT), lead titanate ($PbTiO_3$), lithium tantalate ($LiTaO_3$), lithium niobate ($LiNbO_3$), lithium tetraborate ($Li_2B_4O_7$), langasite ($La_3Ga_5SiO_{14}$), crystal ($SiO_2$), zinc oxide (ZnO), potassium sodium tartrate ($KNaC_4H_4O_6$), aluminum nitride (AlN), tourmaline (silicate mineral), polyvinylidene difluoride (PVDF), VDF oligomer, and fluorine-based piezoelectric material. Those may be in bulk form or may be obtained by thin-film deposition or coating.

The power generation information from the power generation unit 101 is provided to the controller 105. The power generation information may be, for example, a waveform of a voltage itself generated by the power generation unit 101 or may be information obtained by using the waveform of a voltage, such as a waveform level and a time interval between waveforms.

The rectifier circuit 102 rectifies the voltage generated by the power generation unit 101. The rectifier circuit 102 includes, for example, a diode or a diode bridge.

Examples of the power storage unit 103 include an electric double-layer capacitor, a lithium ion capacitor, a polyacenic semiconductor (PAS) capacitor, a nano-gate capacitor ("nano-gate" is registered trademark by Nanogate AG), a ceramic capacitor, a film capacitor, an aluminum electrolytic capacitor, and a tantalum capacitor. The power storage unit 103 stores a direct-current (DC) voltage outputted from the rectifier circuit 102.

The constant-voltage circuit 104 converts an output voltage of the power storage unit 103 into a predetermined voltage to stabilize the output voltage. The output voltage from the power-supply unit 110 (constant-voltage circuit 104) is supplied to, for example, the controller 105 and the memory 106.

In this manner, electric power generated by the power generation unit 101 is stored and the stored electric power is supplied to each unit. Therefore, for example, a power-supply such as a battery for operating each unit may be omitted. Note that the present disclosure is not construed as absolutely excluding the use of the battery. Even in the case where the battery is used, draining and deterioration of the battery may be reduced because electric power is supplied from the power generation unit 101 to each unit.

The controller 105 includes, for example, a central processing unit (CPU) and controls each unit. The controller 105 performs the authentication processing according to the power generation information of the power generation unit 101. That is, the controller 105 functions as an authentication unit. Note that the term "according to the power generation information" means at least one of performing an authentication by the use of the power generation information and using the power generation information as electric power for performing the authentication processing.

If the authentication is successful in the authentication processing, the controller 105 controls the open and close mechanism 107 to unlock the cap portion 10*a*. If the authentication is not successful in the authentication processing, the cap portion 10*a* is not unlocked.

The memory 106 includes, for example, a read only memory (ROM). Of course, the memory 106 may be a rewritable memory such as a random access memory (RAM). The memory 106 records, for example, a waveform pattern generated by the power generation unit 101 when the cap portion 10*a* is rotated a predetermined number of times. For example, the memory 106 records a waveform pattern generated by the power generation unit 101 when the cap portion 10*a* is rotated three times.

The open and close mechanism 107 serves to open and close the cap portion 10*a*. The open and close mechanism 107 is controlled by the controller 105. When the open and close mechanism 107 is locked, the cap portion 10*a* is not allowed to be opened. When the open and close mechanism 107 is not locked, the cap portion 10*a* is allowed to be opened. The structure of the open and close mechanism 107 may be appropriately changed. For example, the cap portion 10*a* may be provided with a claw portion and the claw portion may be engaged to the container unit 10*b*. If the authentication is successful, the cap portion 10*a* may be opened by the cap portion 10*a* meshing with the cap-mounting portion 10*c*. Meanwhile, if the authentication is not successful, the cap portion 10*a* may be prevented from being opened by the cap portion 10*a* spinning around the cap-mounting portion 10*c* without meshing with the cap-mounting portion 10*c*.

Flow of Processing

Figure 6:
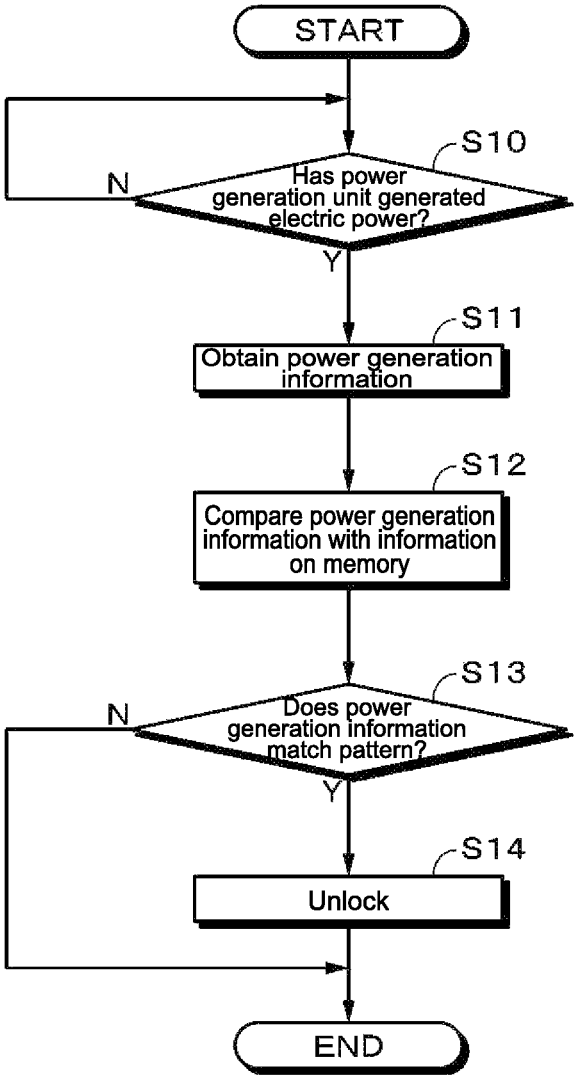
FIG. 6 is a flowchart showing an exemplary flow of processing in the first embodiment.

FIG. 6 is a flowchart showing an exemplary flow of processing in the authentication apparatus 100. In Step S10, the cap portion 10*a* is rotated and a determination is made as to whether or not the power generation unit 101 generates electric power. If the power generation unit 101 does not generate electric power, the processing returns to Step S10 and the determination processing in Step S10 is performed. If the power generation unit 101 generates electric power, the processing proceeds to Step S11.

In Step S11, the power generation information when the power generation unit 101 generates electric power is obtained by the controller 105. Then, the processing proceeds to Step S12.

In Step S12, the controller 105 compares the obtained power generation information with an authentication pattern recorded on the memory 106. Then, the processing proceeds to Step S13.

In Step S13, a determination is made as to whether or not the power generation information matches the authentication pattern. If the power generation information does not match the authentication pattern, the processing is terminated without unlocking the cap portion 10*a*.

When the cap portion 10*a* is rotated three times, the power generation information matches the authentication pattern. If the power generation information matches the authentication pattern, the processing proceeds to Step S14.

In Step S14, the controller 105 unlocks the cap portion 10*a*, determining that the authentication is successful. Then, the processing is terminated. In this manner, the authentication processing is performed using the power generation information obtained when the cap portion 10*a* is rotated. Only by rotating the cap portion 10*a*, an authentication is performed. Thus, complicated operations such as holding and pressing the cap portion 10*a* are unnecessary.

Note that the authentication processing may be performed by a different apparatus. For example, the power generation information is sent from the medicine bottle 10 to the different apparatus by means of communication. The communication may be wired or wireless. Alternatively, communication using a human body as a medium may be performed. The different apparatus is embodied as, for example, a wristwatch- or ring-shaped apparatus, a mobile terminal, or an apparatus attached to a pillow.

For example, using short-distance wireless communication, the power generation information is sent from the medicine bottle 10 to the authentication apparatus. Examples of the wireless communication include, although not limited to, infrared communication, communication in compliance with short range and low consumption type ANT standards, communication in compliance with "Z-Wave" standards (US registered trademark by Zensys A/S CORPORATION), communication in compliance with "Zigbee" standards (registered trademark by ZigBee Alliance), communication in compliance with "Bluetooth Low Energy" standards ("Bluetooth" is registered trademark by Bluetooth SIG, INC.), and "Wi-Fi" communication (registered trademark by Wi-Fi Alliance) that easily forms a network.

The authentication apparatus performs the authentication processing according to the sent power generation information. The authentication processing is, for example, the same as the processing in Steps S12 and S13 of FIG. 6. If the authentication is not successful, the processing is terminated. If the authentication is successful, the authentication apparatus generates a control command for unlocking the open and close mechanism 107. The generated control command is sent to the medicine bottle 10 by means of communication. A communication unit of the medicine bottle 10 receives the control command and provides the control command to the controller 105. The controller 105 unlocks the open and close mechanism 107 according to the provided control command.

In this manner, the authentication processing may be performed by the different apparatus. A person who does not possess the authentication apparatus is not allowed to perform the authentication processing and open the medicine bottle 10.

2. Second Embodiment

Shape of Capsule

Figure 7:
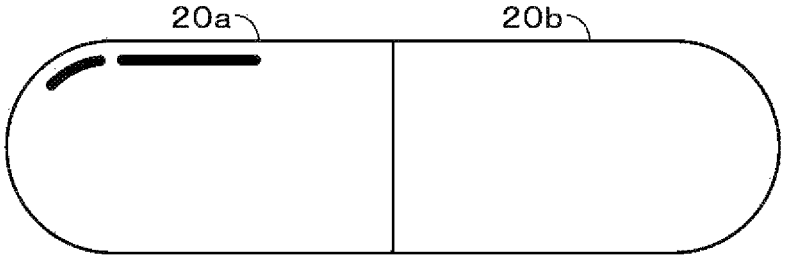
FIG. 7 is a view for explaining an outer appearance of a capsule.

Next, a second embodiment will be described. FIG. 7 shows, by way of example, a capsule type medicine (hereinafter, appropriately referred to as capsule 20) in a second embodiment. The capsule 20 is, almost at a center, divided into a shell part 20*a* and a shell part 20*b*. Typically, the shell part 20*a* and the shell part 20*b* are closely coupled to each other so that powder within the capsule 20 is not released to an outside. The shell part 20*a* and the shell part 20*b* are adapted not to be dissolved due to substances in the body, such as gastric acid.

Figure 8:
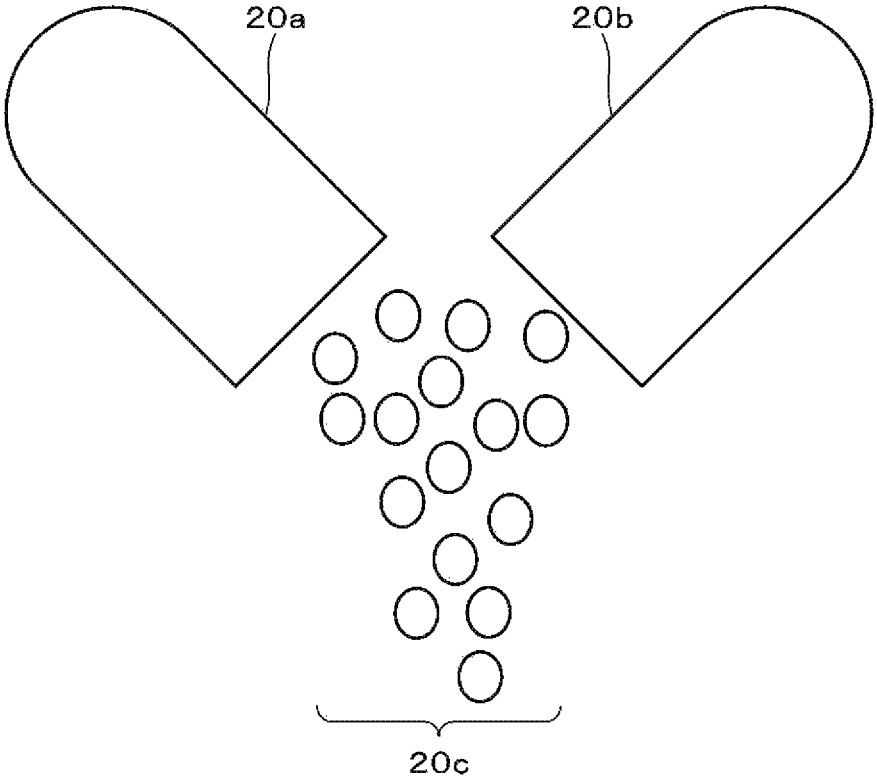
FIG. 8 is a view schematically showing a state in which powder is released from the capsule.

As shown in FIG. 8, when the shell part 20*a* and the shell part 20*b* are decoupled from each other, powder 20*c* within the capsule 20 is released into the body. The shell part 20*a* and the shell part 20*b* are discharged from the body as they are. The capsule 20 is capable of independently decoupling the shell part 20*a* and the shell part 20*b* from each other. For example, the capsule 20 performs an authentication with respect to an external apparatus, and decouples the shell part 20*a* and the shell part 20*b* from each other if the authentication is successful.

Configuration of Capsule

Figure 9:
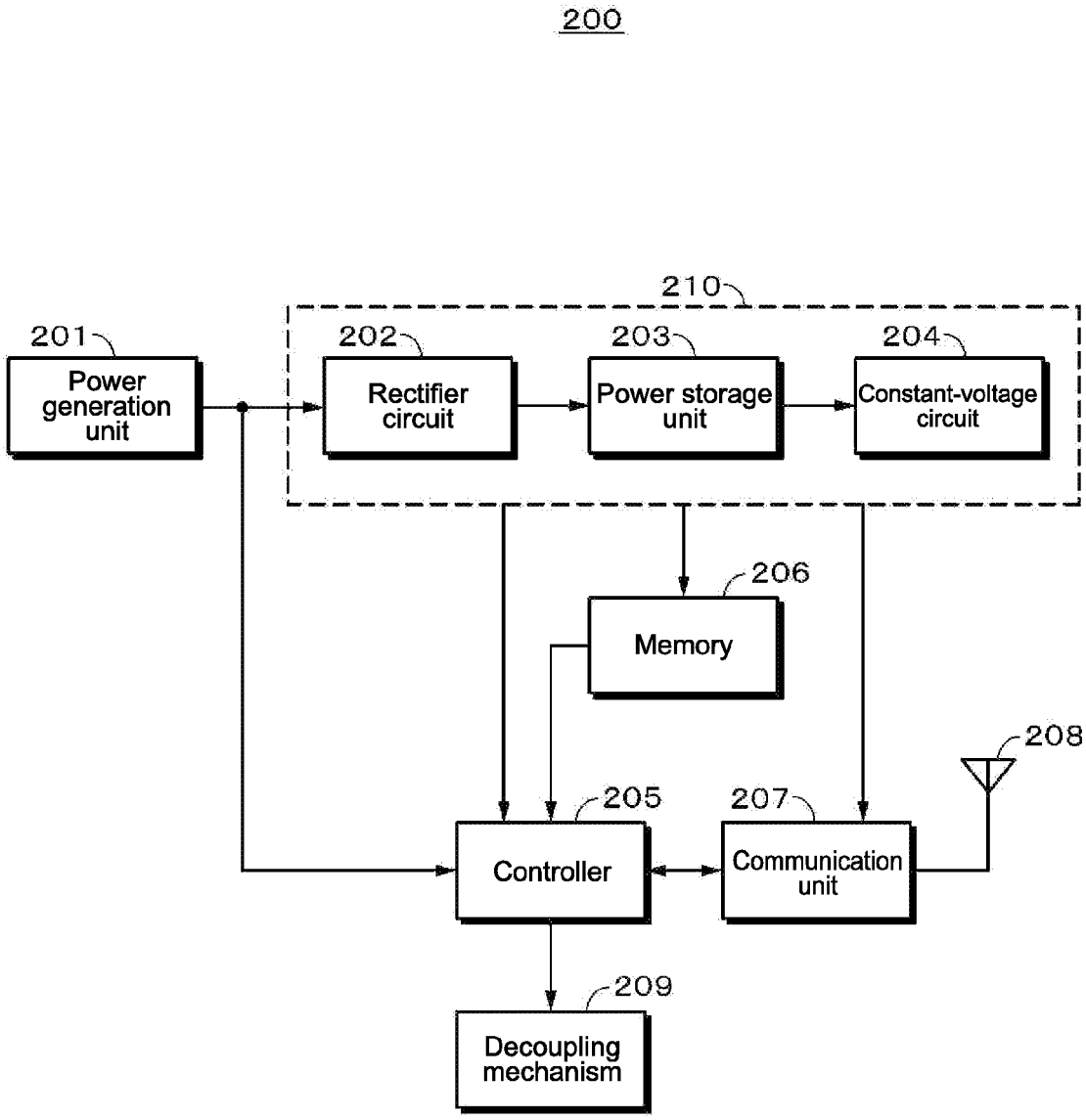
FIG. 9 is a view showing an exemplary configuration of a capsule apparatus.

FIG. 9 shows an exemplary configuration of a capsule apparatus 200 being an electrical configuration of the capsule 20. The capsule apparatus 200 includes a power generation unit 201, a rectifier circuit 202, a power storage unit 203, a constant-voltage circuit 204, a controller 205, a memory 206, a communication unit 207, an antenna 208, and a decoupling mechanism 209. For example, the rectifier circuit 202, the power storage unit 203, and the constant-voltage circuit 204 constitute a power-supply unit 210.

The power generation unit 201 is, for example, a piezoelectric element that generates electric power due to a vibration. When the capsule 20 is administered in the body, the power generation unit 201 generates electric power due to a vibration caused when the capsule 20 passes through the body or a vibration in the body that is caused by a movement of the body. The power generation unit 201 may generate electric power due to a difference in temperature between an inside and an outside of the capsule 20. The power generation unit 201 may generate electric power due to a difference in ion concentration or due to wireless power feeding. Alternatively, the power generation unit 201 may generate electric power by a sugar-enzyme battery technology in which electric power is generated using sugar of food ingested in the body.

The power generation information from the power generation unit 201 is provided to the controller 205. The power generation information may be, for example, a waveform of a voltage itself generated by the power generation unit 201 or may be information obtained by using the waveform of a voltage, such as information on a waveform level and a time interval between waveforms.

The rectifier circuit 202 rectifies the voltage generated by the power generation unit 201. The rectifier circuit 202 includes, for example, a diode or a diode bridge.

Examples of the power storage unit 203 include an electric double-layer capacitor, a lithium ion capacitor, a PAS capacitor, a nano-gate capacitor, a ceramic capacitor, a film capacitor, an aluminum electrolytic capacitor, and a tantalum capacitor. The power storage unit 203 stores a DC voltage outputted from the rectifier circuit 202.

The constant-voltage circuit 204 converts an output voltage of the power storage unit 203 into a predetermined voltage to stabilize the output voltage. The output voltage from the power-supply unit 210 (constant-voltage circuit 204) is supplied to, for example, the controller 205 and the memory 206.

In this manner, electric power generated by the power generation unit 201 is stored and the stored electric power is supplied to each unit. Therefore, for example, a power-supply such as a battery for operating each unit may be omitted. Note that the present disclosure is not construed as absolutely excluding the use of the battery. Even in the case where the battery is used, draining and deterioration of the battery may be reduced because electric power is supplied from the power generation unit 201 to each unit.

The controller 205 includes, for example, a CPU and controls each unit of the capsule apparatus 200. The controller 205 operates with electric power supplied from the power generation unit 201. The controller 205 communicates with an external apparatus. For example, the controller 205 generates a request signal for requesting an identification (ID) from the external apparatus. The controller 205 supplies the generated request signal to the communication unit 207. Predetermined processing such as modulation processing is performed on the request signal by the communication unit 207. The request signal subjected to the predetermined processing is sent to the external apparatus through the antenna 208.

The controller 205 further performs authentication processing. If the authentication is successful, the controller 205 controls the decoupling mechanism 209 to decouple the shell part 20*a* and the shell part 20*b* from each other. When the shell part 20*a* and the shell part 20*b* are decoupled from each other, the powder 20*c* within the capsule 20 is released into the body.

The memory 206 includes, for example, a ROM and records a predetermined ID. This ID is used as authentication data.

The communication unit 207 performs processing of modulating the request signal to be sent to the external apparatus, processing of demodulating the ID provided from the external apparatus, and the like. The request signal modulated by the communication unit 207 is sent to the external apparatus through the antenna 208. The ID demodulated by the communication unit 207 is provided to the controller 205. The communication unit 207 may include the antenna 208. Note that, other than the wireless communication, the communication performed by the communication unit 207 may be human-body communication in which a human body is used as a dielectric body.

The decoupling mechanism 209 is a mechanism to decouple the shell part 20*a* and the shell part 20*b* from each other. Although the mechanism may be appropriately changed, the mechanism is configured, for example, so that the powder 20*c* is not released to the outside of the capsule 20 by fixing the shell part 20*a* and the shell part 20*b* to each other with a hook-shaped fixture. By the controller 205 releasing the hook-shaped fixture, the shell part 20*a* and the shell part 20*b* are decoupled from each other.

Configuration of External Apparatus

The external apparatus that communicates with the capsule apparatus 200 will be described. The external apparatus is, for example, attached to the body of the user who takes the capsule 20. The external apparatus has a ring- or bracelet-shape, for example. The external apparatus is not limited to be attached to the body of the user. For example, the external apparatus may be provided to personal belongings such as a mobile terminal and a pillow.

Figure 10:
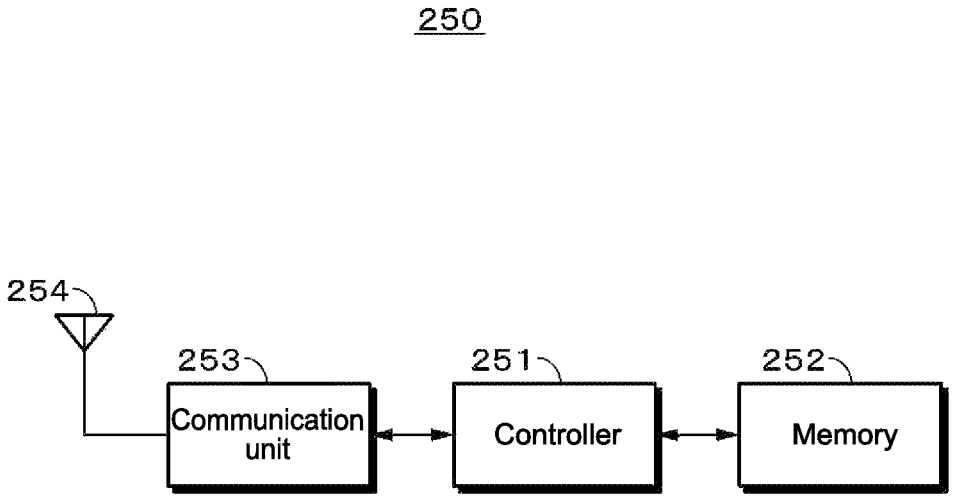
FIG. 10 is a view showing an exemplary configuration of an external apparatus.

FIG. 10 shows an exemplary main configuration of an external apparatus 250. The external apparatus 250 includes a controller 251, a memory 252, a communication unit 253, and an antenna 254. Note that other components such as a display unit may be appropriately added to the external apparatus 250.

The controller 251 includes, for example, a CPU and controls each unit of the external apparatus 250. The controller 251 provides an ID to the capsule apparatus 200 according to a request signal received from the capsule apparatus 200. The controller 251 generates, for example, an ID signal in a predetermined format, the ID signal indicating an ID recorded on the memory 252. Then, the controller 251 supplies the ID signal to the communication unit 253. The communication unit 253 modulates the ID signal and the modulated ID signal is supplied to the capsule apparatus 200 through the antenna 254.

The memory 252 includes, for example, a ROM and records a predetermined authentication ID. The communication unit 253 performs processing of modulating the ID signal to be sent to the capsule apparatus 200, processing of demodulating the request signal supplied from the capsule apparatus 200, and the like. The ID signal modulated by the communication unit 253 is sent to the capsule apparatus 200 through the antenna 254. The request signal demodulated by the communication unit 253 is supplied to the controller 251. The communication unit 253 may include the antenna 254. Note that, other than the wireless communication, the communication performed by the communication unit 253 may be human-body communication in which a human body is considered as a dielectric body.

Flow of Processing

Figure 11:
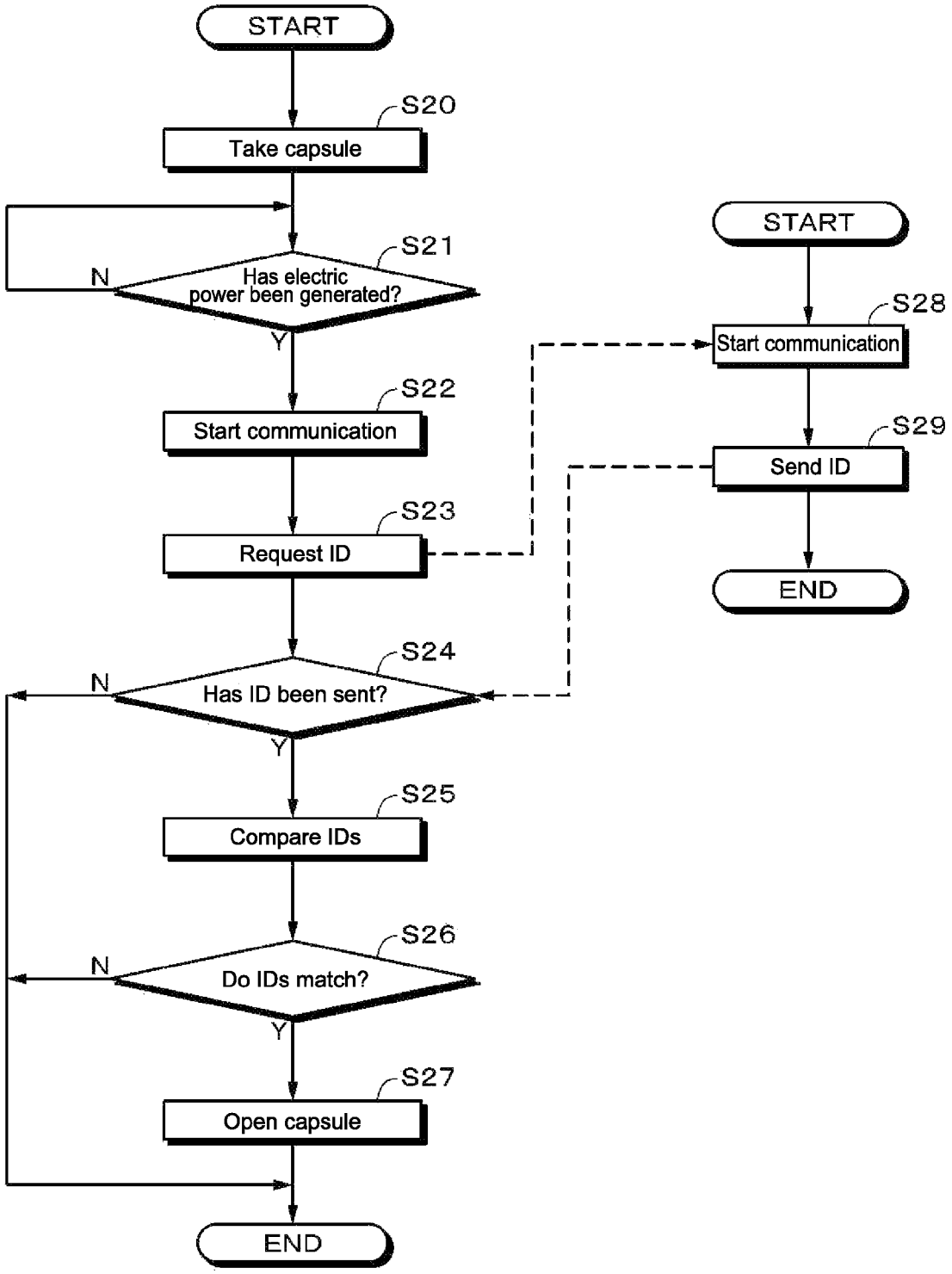
FIG. 11 is a flowchart showing an exemplary flow of processing in a second embodiment.

FIG. 11 is a flowchart showing an exemplary flow of processing of communication between the capsule apparatus 200 and the external apparatus 250. In FIG. 11, a flow of processing shown on the left-hand side in the figure shows a flow of processing performed by the capsule apparatus 200. In FIG. 11, a flow of processing shown on the right-hand side in the figure shows a flow of processing performed by the external apparatus 250.

In Step S20, the capsule 20 is administered. Then, the processing proceeds to Step S21. In Step S21, a determination is made as to whether or not the power generation unit 201 generates electric power. If the power generation unit 201 does not generate electric power, the processing returns to Step S21. If the power generation unit 201 generates electric power, the processing proceeds to Step S22.

In Step S22, the controller 205 generates a request signal for requesting an ID and performs a control to start communication. Then, the processing proceeds to Step S23.

In Step S23, the request signal for requesting the ID is sent to the external apparatus 250 through the communication unit 207 and the antenna 208.

In Step S28, the external apparatus 250 receives the request signal. The controller 251 of the external apparatus 250 reads the ID from the memory 252 according to the request signal. Then, an ID signal corresponding to the read ID is generated. In Step S29, the ID signal is sent to the capsule apparatus 200 through the communication unit 253 and the antenna 254.

In the capsule apparatus 200, in Step S24, a determination is made as to whether or not the ID signal is sent. Here, for example, when the external apparatus 250 does not send the ID signal for a predetermined period of time, the processing is terminated. In this case, the shell part 20*a* and the shell part 20*b* are not decoupled from each other and the powder 20*c* is not released into the body. The capsule 20 is discharged from the body with the shell parts being not decoupled from each other.

In Step S24, if it is determined that the external apparatus 250 sends the ID signal, the processing proceeds to Step S25. The ID signal is sent to the controller 205 through the antenna 208 and the communication unit 207. In Step S25, the controller 205 performs processing of comparing the IDs with each other. That is, the controller 205 makes a determination as to whether or not the ID indicated by the ID signal matches the ID read from the memory 206.

In Step S26, if it is determined that the IDs do not match, the controller 205 determines that the authentication is not successful and the processing is terminated. In Step S26, if it is determined that the IDs match, the controller 205 determines that the authentication is successful and the processing proceeds to Step S27.

In Step S27, the capsule 20 is opened. That is, the controller 205 performs a decoupling control on the decoupling mechanism 209. Under this control, the shell part 20*a* and the shell part 20*b* are decoupled from each other and the powder 20*c* is released from the capsule 20 into the body. In this manner, if the authentication is successful, the powder within the capsule is allowed to be released. For example, even if a child accidentally takes the capsule, the powder within the capsule is prevented from being released into the body. The capsule is excreted from the body, which does not cause a problem.

The capsule apparatus 200 may measure a ph level of the surroundings to identify a particular organ based on the ph level. Then, if it is determined that the authentication is successful and the capsule 20 is present in the particular organ, the powder 20*c* may be released. Alternatively, the IDs may be replaced by deoxyribonucleic acid (DNA) chips as the authentication data.

3. Third Embodiment

Outline of Third Embodiment

Figure 12:
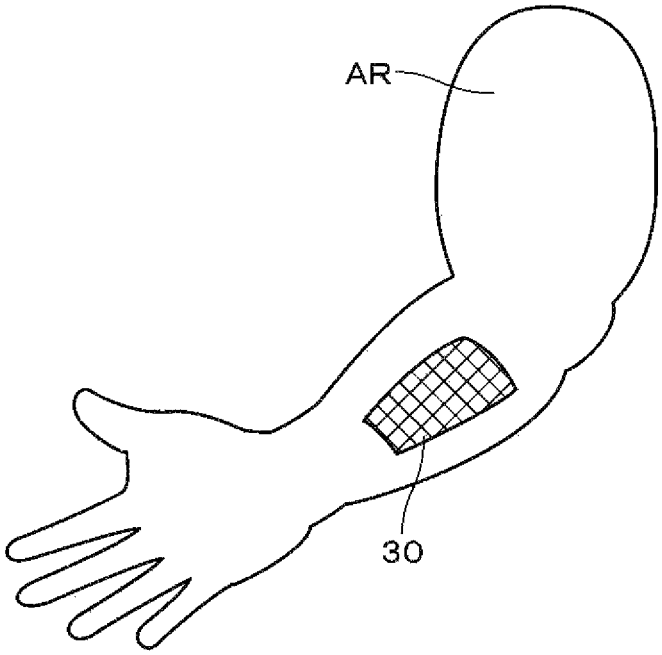
FIG. 12 is a view schematically showing an outline of a third embodiment.

FIG. 12 shows an outline of a third embodiment. In the third embodiment, a transdermal medicine patch 30 is attached to the body of the user (e.g., arm of user). The transdermal medicine patch 30 is set to have a thickness the same as that of a card, for example. Unlike orally administered medicine, the transdermal medicine patch has no limitations in administration intervals, for example, taking medicine after meals or when an attack symptom occurs.

However, there is a problem in that the transdermal medicine patch releases ingredients of the transdermal medicine patch irrespective of whether or not a person who takes medicine is a patient who needs to take medicine. For example, if a child accidentally attaches a transdermal medicine patch on his or her body, there is a problem in that ingredients of the transdermal medicine patch are released into the body of the child. In the third embodiment, if the authentication is successful, ingredients of the transdermal medicine patch are released.

Configuration of Authentication Apparatus

Figure 13:
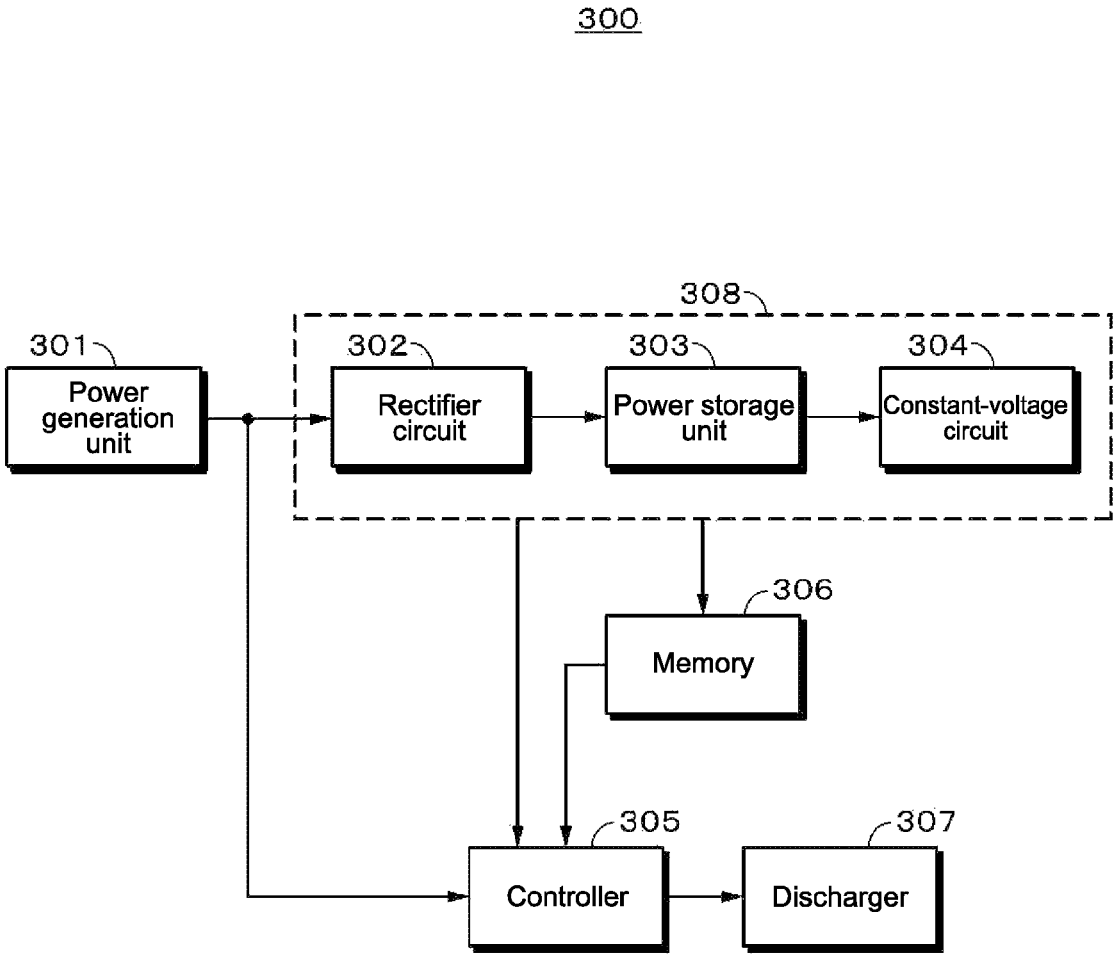
FIG. 13 is a view showing an exemplary configuration of an authentication apparatus in the third embodiment.

The transdermal medicine patch 30 includes an authentication apparatus 300. The authentication apparatus 300 is attached, for example, as a single-chip-like apparatus, to the transdermal medicine patch 30. FIG. 13 shows an exemplary configuration of the authentication apparatus 300. The authentication apparatus 300 includes a power generation unit 301, a rectifier circuit 302, a power storage unit 303, a constant-voltage circuit 304, a controller 305, a memory 306, and a discharger 307. For example, the rectifier circuit 302, the power storage unit 303, and the constant-voltage circuit 304 constitute a power-supply unit 308.

The power generation unit 301 is, for example, a piezoelectric element (micro-piezo element) that generates electric power due to a vibration. The power generation unit 301 may generate electric power due to heat of a surface of a skin. The power generation unit 301 may generate electric power due to a difference in ion concentration. Regarding the generation of electric power due to the difference in ion concentration, as an invasive type, there is one that obtains electrical energy due to a difference in ion concentration between a body site (e.g., dermis) and another site or a body surface. As a non-invasive type, there is, for example, one that obtains electrical energy due to sweat on the body surface. The power generation information from the power generation unit 301 is provided to the controller 305.

The rectifier circuit 302 rectifies the voltage generated by the power generation unit 301. The rectifier circuit 302 includes, for example, a diode or a diode bridge.

Examples of the power storage unit 303 include an electric double-layer capacitor, a lithium ion capacitor, a PAS capacitor, a nano-gate capacitor, a ceramic capacitor, a film capacitor, an aluminum electrolytic capacitor, and a tantalum capacitor. The power storage unit 303 stores a DC voltage outputted from the rectifier circuit 302.

The constant-voltage circuit 304 converts an output voltage of the power storage unit 303 into a predetermined voltage to stabilize the output voltage. The output voltage from a power-supply unit 310 (constant-voltage circuit 304) is supplied to, for example, the controller 305 and the memory 306.

In this manner, electric power generated by the power generation unit 301 is stored and the stored electric power is supplied to each unit. Therefore, for example, a power-supply such as a battery for operating each unit may be omitted. Note that the present disclosure is not construed as absolutely excluding the use of the battery. Even in the case where the battery is used, draining and deterioration of the battery may be reduced because electric power is supplied from the power generation unit 301 to each unit.

The controller 305 includes, for example, a CPU and controls each unit of the authentication apparatus 300. The controller 305 performs authentication processing according to the power generation information of the power generation unit 301. If the authentication is successful, the controller 305 controls the discharger 307 so that ingredients of the transdermal medicine patch are released from the discharger 307 into the body through the skin.

The memory 306 includes, for example, a ROM and records a pattern of power generation information. A plurality of patterns of the power generation information may be recorded. For example, a pattern of power generation information corresponding to activity (amount of physical activity) for an adult and the dose of liquid medicine corresponding to the amount of physical activity are recorded on the memory 306.

The discharger 307 has, for example, an extremely small needle-like shape. In one surface of the transdermal medicine patch 30 (surface attached to skin), a plurality of dischargers 307 are formed. Under the control by the controller 305, the liquid medicine is injected into the discharger 307. The injected liquid medicine is discharged from the discharger 307 and then absorbed into the body through the skin. In order to administer an appropriate dose of liquid medicine corresponding to the amount of physical activity, the power generation information is appropriately replaced by the amount of physical activity and that amount of physical activity is compared with a pattern of the amount of physical activity recorded on the memory 306.

Flow of Processing

Figure 14:
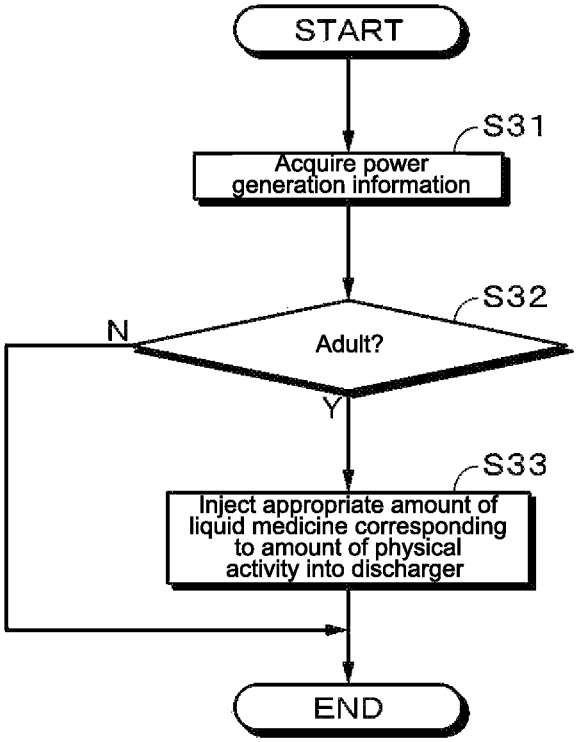
FIG. 14 is a flowchart showing an exemplary flow of processing in the third embodiment.

FIG. 14 is a flowchart showing an exemplary flow of processing according to the third embodiment. In Step S31, the controller 305 acquires power generation information generated by the power generation unit 301. Then, the processing proceeds to Step S32.

In Step S32, the controller 305 compares the power generation information provided from the power generation unit 301 with the power generation information recorded on the memory 306. Here, the memory 306 records a pattern of power generation information based on the amount of physical activity for an adult, for example. If the power generation information provided from the power generation unit 301 almost corresponds to the pattern of the power generation information recorded on the memory 306, it can be determined that the user using the transdermal medicine patch 30 is adult. In Step S32, if it is determined that the user using the transdermal medicine patch 30 is not adult, the processing is terminated.

In Step S32, if it is determined that the user using the transdermal medicine patch 30 is adult, the processing proceeds to Step S33. In Step S33, the controller 305 injects a necessary amount of liquid medicine into the discharger 307. For example, the amount of physical activity corresponding to the power generation information is acquired and an amount of liquid medicine corresponding to the acquired amount of physical activity is injected into the discharger 307. For example, the amount of physical activity corresponding to the power generation information and the amount of liquid medicine corresponding to the amount of physical activity are recorded on the memory 306 in advance. Accordingly, the controller 305 acquires the amount of physical activity by reading the amount of physical activity corresponding to the power generation information. The amount of physical activity may be acquired by performing a predetermined calculation on the power generation information. The amount of liquid medicine corresponding to the power generation information may be recorded on the memory 306. The injected liquid medicine is discharged from the discharger 307 and then absorbed in the body through the skin.

By the above-mentioned processing, for example, even if a child accidentally attaches the transdermal medicine patch 30 on his or her body, ingredients of the transdermal medicine patch can be prevented from being absorbed in the body. In addition, for adults, an amount of liquid medicine corresponding to the amount of physical activity of the user can be absorbed in the body. With this, for example, a medicine effect corresponding to the amount of physical activity can be given.

Note that, after the authentication is successful, the liquid medicine may be intermittently injected into the discharger 307 or a predetermined amount of liquid medicine may be regularly injected. A record of injection of the liquid medicine into the discharger 307 may be retained.

The memory 306 may record a pattern of power generation information corresponding to the amount of physical activity or the life style of an individual person. An authentication as to whether or not the user using the transdermal medicine patch 30 is that individual person may be performed. In addition, not limiting to the amount of physical activity and the like, a pattern of power generation information corresponding to a body temperature may be recorded.

4. Fourth Embodiment

Outline of Fourth Embodiment

Figure 15A:
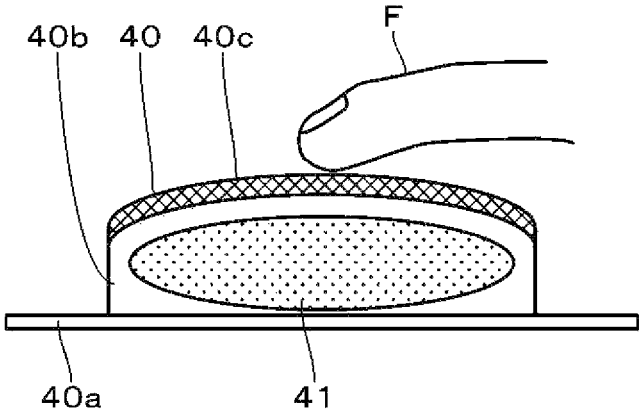
FIGS. 15A and 15B are views each schematically showing an outline of a fourth embodiment.
Figure 15B:
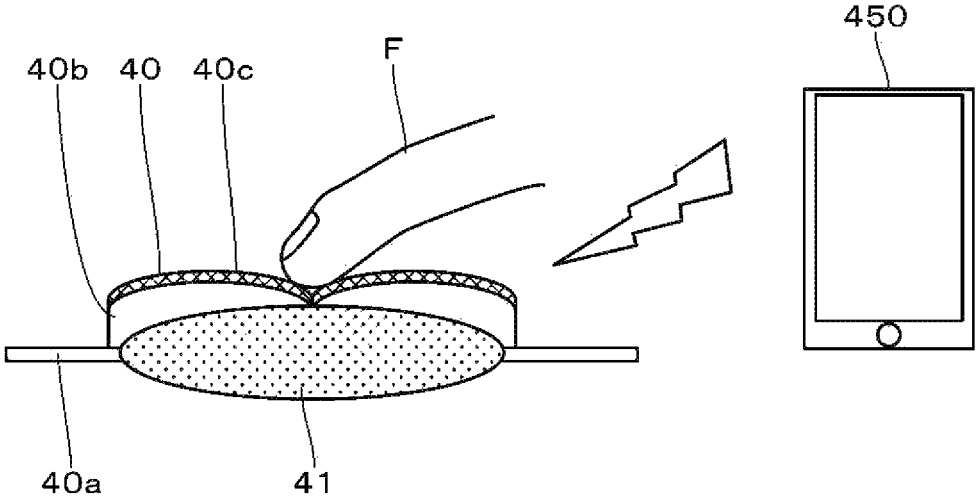

Next, a fourth embodiment will be described. In the fourth embodiment, for example, records (logs) of timing of taking medicine are stored. FIGS. 15A and 15B each show an outline of the fourth embodiment. As shown in FIG. 15A, a medicine 41 is packed in a package form called a press-through-package (PTP). The PTP 40 includes a thin-plate-like metal portion 40*a* made of aluminum or the like and a plastic portion 40*b* formed to protrude from the metal portion 40*a*. As shown in FIG. 15B, by a finger F pressing the plastic portion 40*b*, the medicine 41 is ejected.

At a position to be pressed by the finger F, a power generation unit is formed. The power generation unit is, for example, a piezoelectric element 40*c* that generates electric power by being pressed. As shown in FIG. 15B, when the finger F presses the piezoelectric element 40*c*, the piezoelectric element 40*c* generates electric power. In response to the generation of electric power by the piezoelectric element 40*c*, predetermined data is sent to a mobile terminal 450. Note that, although not shown in the figures, a chip-like transmitter 400 is attached to the PTP 40.

Configuration of Transmitter

Figure 16:
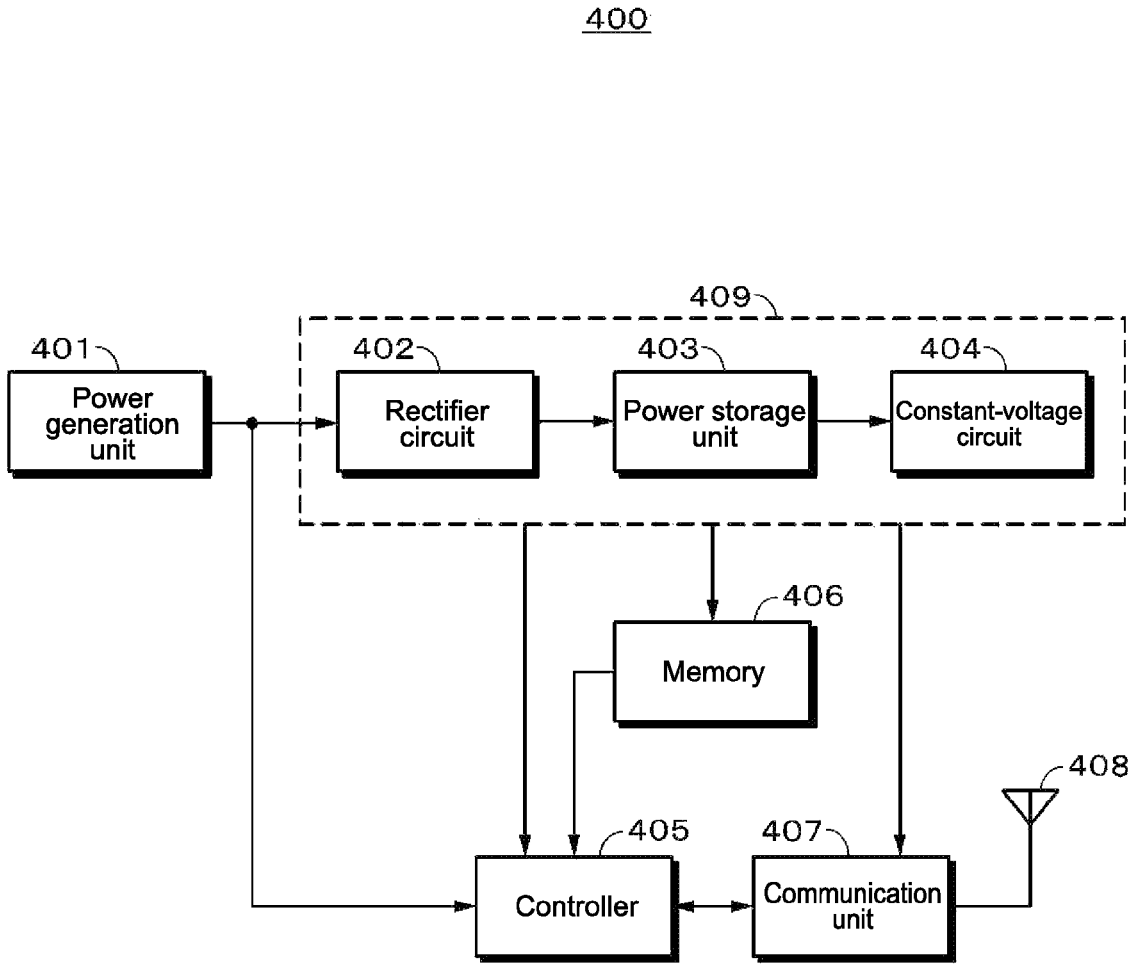
FIG. 16 is a view showing an exemplary configuration of a transmitter.

FIG. 16 shows an exemplary configuration of the transmitter 400. The transmitter 400 includes a power generation unit 401, a rectifier circuit 402, a power storage unit 403, a constant-voltage circuit 404, a controller 405, a memory 406, a communication unit 407, and an antenna 408. For example, the rectifier circuit 402, the power storage unit 403, and the constant-voltage circuit 404 constitute a power-supply unit 409.

The power generation unit 401 is, for example, the piezoelectric element 40*c*. When the medicine 41 is ejected, the position of the piezoelectric element 40*c* is pressed and the power generation unit 401 generates electric power. The power generation information from the power generation unit 401 is provided to the controller 405. The power generation information may be, for example, a waveform of a voltage generated by the power generation unit 401 or may be information obtained by using the waveform of a voltage, such as information on a waveform level and a time interval between waveforms.

The rectifier circuit 402 rectifies the voltage generated by the power generation unit 401. The rectifier circuit 402 includes, for example, a diode or a diode bridge.

Examples of the power storage unit 403 include an electric double-layer capacitor, a lithium ion capacitor, a PAS capacitor, a nano-gate capacitor, a ceramic capacitor, a film capacitor, an aluminum electrolytic capacitor, and a tantalum capacitor. The power storage unit 403 stores a DC voltage outputted from the rectifier circuit 402.

The constant-voltage circuit 404 converts an output voltage of the power storage unit 403 into a predetermined voltage to stabilize the output voltage. The output voltage from the power supply 409 (constant-voltage circuit 404) is supplied to, for example, the controller 405 and the memory 406.

In this manner, electric power generated by the power generation unit 401 is stored and the stored electric power is supplied to each unit. Therefore, for example, a power-supply such as a battery for operating each unit may be omitted. Note that the present disclosure is not construed as absolutely excluding the use of the battery. Even in the case where the battery is used, draining and deterioration of the battery may be reduced because electric power is supplied from the power generation unit 401 to each unit.

The controller 405 includes, for example, a CPU and controls each unit of the transmitter 400. The controller 405 operates with electric power supplied from the power generation unit 401. The controller 405 communicates with the mobile terminal 450. For example, the controller 405 sends an ID signal in a predetermined format to the external apparatus. The controller 405 supplies a generated ID signal to the communication unit 407. Predetermined processing such as modulation processing is performed on the ID signal by the communication unit 407. The ID signal subjected to the predetermined processing is sent to the mobile terminal 450 through the antenna 408.

The memory 406 includes, for example, a ROM and records a predetermined ID. The predetermined ID is, for example, an ID assigned for each type of medicine.

The communication unit 407 performs processing and the like of modulating the ID signal to be sent to the mobile terminal 450. The ID signal modulated by the communication unit 407 is sent to the mobile terminal 450 through the antenna 408. Note that the communication unit 407 may include the antenna 408.

Configuration of Mobile Terminal

Figure 17:
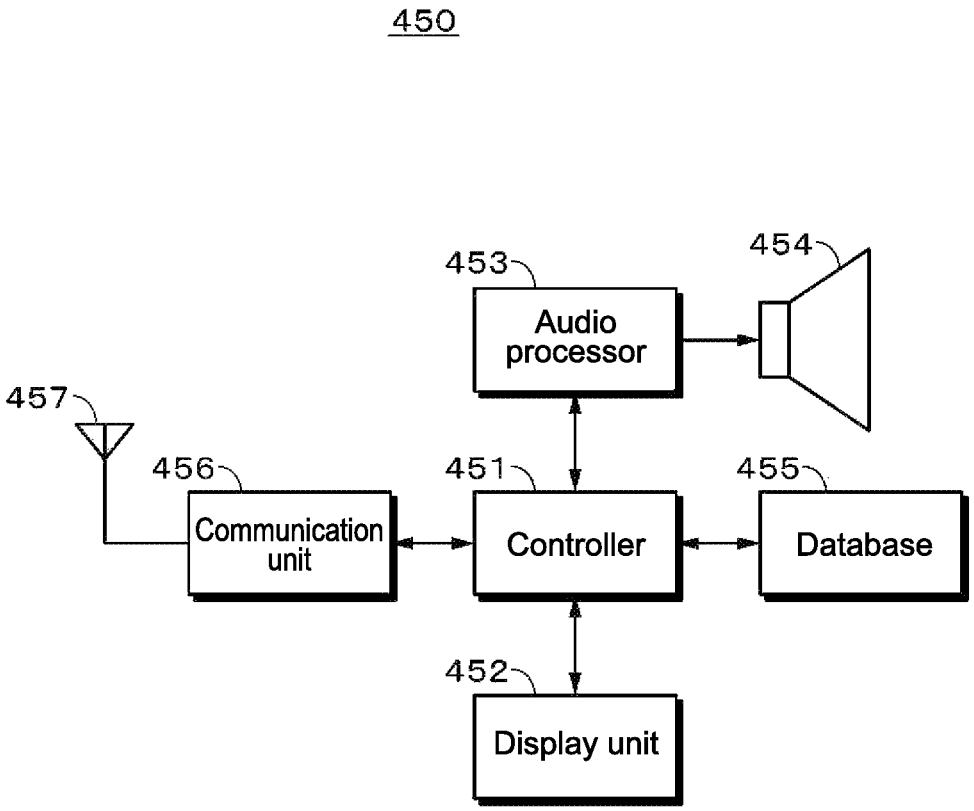
FIG. 17 is a view showing an exemplary configuration of a mobile terminal.

FIG. 17 shows an exemplary configuration of a mobile terminal. The mobile terminal 450 includes, for example, a controller 451, a display unit 452, an audio processor 453, a speaker 454, a database 455, a communication unit 456, and an antenna 457.

The controller 451 includes, for example, a CPU and controls each unit of the mobile terminal 450. The controller 451 stores, in a database, records of timing of sending ID signals by the transmitter 400, for example. Note that, although not shown in the figure, the controller 451 includes a real-time clock (RTC) that keeps track of the current time.

The display unit 452 includes a display panel such as a liquid crystal display (LCD) and an organic electroluminescence (EL) display and a display driver for driving the display panel. On the display unit 452, a menu screen or the like for operating the mobile terminal 450 is displayed. Note that the display unit 452 may be configured as a touch panel.

The audio processor 453 performs analog to digital (A/D) conversion processing, level-control processing, and the like on audio data. The audio data subjected to the processing by the audio processor 453 is reproduced through the speaker 454. Through the speaker 454, a sound or the like informing of timing to take medicine, for example, is reproduced.

The database 455 includes, for example, a non-volatile memory. The database 455 may be a memory removable from the mobile terminal 450. In the database 455, for example, timing of sending ID signals by the transmitter 400 is recorded.

The communication unit 456 performs, for example, processing of modulating the ID signal received through the antenna 457. The ID signal modulated by the communication unit 456 is supplied to the controller 451. When the mobile terminal 450 sends data, the communication unit 456 performs processing of modulating data and the like. Note that the communication unit 456 may include the antenna 457.

Flow of Processing

Figure 18:
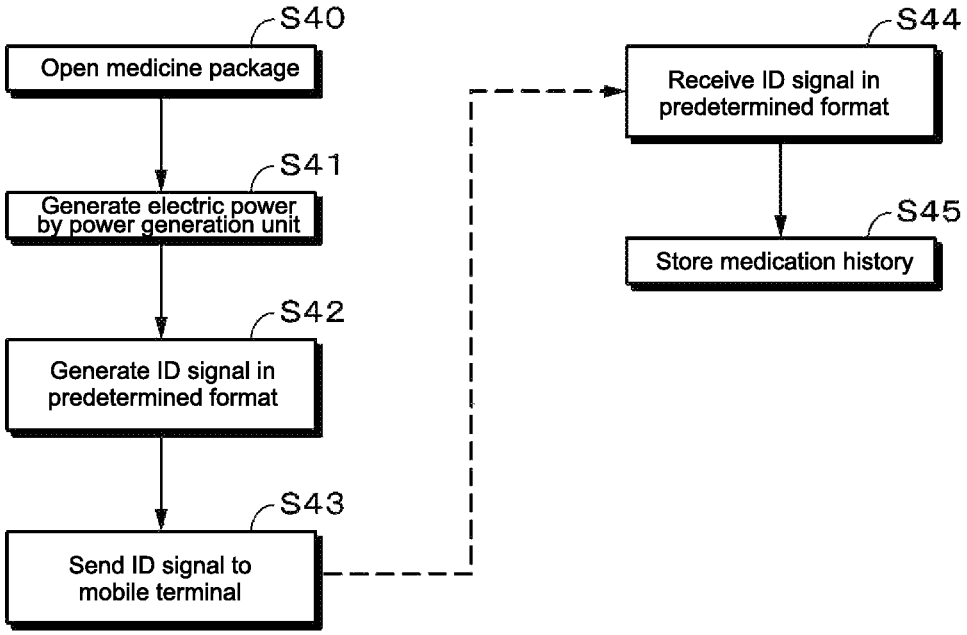
FIG. 18 is a flowchart showing an exemplary flow of processing in the fourth embodiment.

FIG. 18 is a flowchart showing an exemplary flow of processing in the fourth embodiment. In FIG. 18, processing on the left-hand side shows processing by the transmitter 400. In FIG. 18, processing on the right-hand side shows processing by the mobile terminal 450.

In Step S40, when the piezoelectric element 40*c* is pressed, the PTP 40 is opened and the medicine 41 is ejected. Then, the processing proceeds to Step S41. In Step S41, in response to the piezoelectric element 40*c* being pressed, the power generation unit 401 generates electric power. Then, the processing proceeds to Step S42.

In Step S42, the controller 405 generates a signal in a predetermined format. Based on the generation of electric power by the power generation unit 401, it can be determined that the medicine 41 is administered. The controller 405 notifies the mobile terminal 450 of the administration of the medicine 41. The signal in the predetermined format is an ID signal corresponding to an ID recorded on the memory 406. The processing proceeds to Step S43.

In Step S43, the ID signal is sent to the mobile terminal 450 through the communication unit 407 and the antenna 408.

In Step S44, the mobile terminal 450 receives an ID signal. The ID signal is received by the antenna 457 and the received ID signal is subjected to demodulation processing or the like by the communication unit 456. The ID signal subjected to the demodulation processing or the like is supplied to the controller 451. When an ID indicated by the ID signal is a desired ID, the controller 451 records date and time information obtained by the RTC in the database 455. In this manner, by recording timing of generating electric power by the power generation unit, medication history can be stored (Step S45).

Note that, for example, using the medication history stored in the database, the user may learn timing to take medicine. If the ID signal is not sent after a predetermined time elapses from the timing (time) obtained by the learning, it may be determined that the user has forgotten to take medicine. Then, by reproducing a warning message or the like through a speaker of a mobile terminal, it may be possible to encourage the user to take medicine.

In addition, if an ID signal is supplied at timing different from the timing obtained by the learning, for example, it may be determined that there is a fear that a child accidentally opens the PTP 40. Then, an alarm sound may be reproduced through the speaker of the mobile terminal With this, the child can be prevented from accidentally taking medicine.

5. Modified Examples

Although the embodiments of the present disclosure have been described above, the present disclosure is not limited to the above-mentioned embodiments and various modifications may be made. Modified examples will be described below.

For example, the contents of the bottle (medicine bottle 10) illustrated in the first embodiment are not limited to the medicines. For example, sugar, salt, or the like may be contained. Not limited to the power, liquid such as shampoo and rinse may be contained. Thus, a general-purpose bottle may be used.

Note that, favorably, if the authentication is successful, a sound (message) informing of the contents of a bottle is reproduced. It is possible to prevent the user who has succeeded in an authentication from mistaking the contents of the bottle. Other than the message, a melody corresponding to the contents may be reproduced. The messages and melodies are recorded on a memory, for example. The messages and melodies may be reproduced through a speaker provided to the bottle. The messages and melodies may be sent to a mobile terminal or a home sever and reproduced through the mobile terminal or the home sever.

In the case where a bottle contains medicines, the user may be encouraged to be careful by vibrating the bottle. In addition, a message may be displayed. The user may be encouraged to be careful by lighting a light emitting diode (LED) or the like.

If authentication is successful, an appropriate dose of medicine or the like may be supplied. For example, a drinking cup is provided with a piezoelectric element. The piezoelectric element may be pressed a predetermined number of times and authentications may be performed corresponding to the number of times. If the authentication is successful, an appropriate dose of medicine may be discharged from a faucet or the like.

The present disclosure may be realized as, other than the apparatus, a method or a system including a plurality of apparatuses. In addition, the present disclosure is applicable to a so-called cloud computing system in which the illustrated processing is distributed and processed by a plurality of apparatuses. For example, in a system in which all or part of the illustrated processing is performed, the present disclosure may also be configured as an apparatus that performs part of the all or part of the illustrated processing.

Note that the configurations and processing of the embodiments and the modified examples are merely examples and addition, elimination, and change of the configurations and the like may be appropriately made unless technical contradiction occurs. In addition, the configurations, the materials, and the communication systems, and the like illustrated in the embodiments and the modified examples may be appropriately combined unless technical contradiction occurs.

It should be noted that the present disclosure may also take the following configurations.

(1) An authentication apparatus, including
  an authentication unit configured to perform authentication processing according to power generation information from a power generation unit configured to generate electric power from ambient energy.

(2) The authentication apparatus according to (1), in which the electric power generated by the power generation unit is supplied to the authentication unit.

(3) The authentication apparatus according to (1), further including
  a recording unit configured to record timing of generating the power generation information by the power generation unit.

(4) The authentication apparatus according to (1) or (2), further including
  a recording unit configured to record predetermined power generation information, in which
  the authentication unit is configured to perform the authentication processing by comparing the predetermined power generation information with the power generation information from the power generation unit.

(5) An authentication method for an authentication apparatus, including
  performing authentication processing according to power generation information from a power generation unit configured to generate electric power from ambient energy.

(6) An authentication system, including:
  a power generation unit configured to generate electric power from ambient energy; and
  an authentication unit configured to perform authentication processing according to power generation information from the power generation unit.

(7) A container system, including:
  a container unit configured to contain a predetermined object; and
  an authentication unit configured to perform authentication processing according to power generation information from a power generation unit configured to generate electric power from ambient energy.

(8) The container system according to (7), further including allowing the contained object to be ejected from the container unit to an outside if the authentication is successful in the authentication processing.

(9) The container system according to (7), further including releasing the contained object from the container unit to an outside if the authentication is successful in the authentication processing.

(10) The container system according to (7), further including containing an appropriate amount of object out of the contained object if the authentication is successful in the authentication processing.

(11) The container system according to (7), further including providing information indicating the contained object if the authentication is successful in the authentication processing.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An authentication apparatus, comprising: a power generation unit configured to generate power from an element selected from the group consisting of heat of a surface of a skin, a difference in ion concentration between a body site and another site or a body surface, sweat on the body surface, and combinations thereof:

an authentication unit configured to perform authentication by using power generation information of the power generation unit as electric power for performing the authentication and comparing the power generation information with predetermined power generation information, wherein the power generation information is selected from the group consisting of a waveform of a voltage generated by the power generation unit, a waveform level, a time interval between multiple waveforms, and combinations thereof; and a memory configured to record the predetermined power generation information.

2. The authentication apparatus according to claim 1, further comprising a controller configured to record timing of generating the power generation information by the power generation unit.

3. An authentication method for an authentication apparatus, comprising:

generating power by a power generation unit from an element selected from the group consisting of heat of a surface of a skin, a difference in ion concentration between a body site and another site or a body surface, sweat on the body surface, and combinations thereof recording predetermined power generation information;

performing authentication by using power generation information from the power generation unit as electric power and comparing the predetermined power generation information with the power generation information, wherein the power generation information is selected from the group consisting of a waveform of a voltage generated by the power generation unit, a waveform level, a time interval between multiple waveforms, and combinations thereof.

4. An authentication system, comprising: a power generation unit configured to generate power generation information selected from the group consisting of a waveform of a voltage generated by the power generation unit, a waveform level, a time interval between multiple waveforms, and combinations thereof wherein the power generation unit is configured to generate power from an element selected from the group consisting of heat of a surface of a skin, a difference in ion concentration between a body site and another site or a body surface, sweat on the body surface, and combinations thereof:

an authentication unit configured to perform authentication by using the power generation information as electric power and comparing the power generation information with predetermined power generation information; and a memory configured to record the predetermined power generation information.

5. A container system, comprising: a container unit configured to contain a predetermined object;

a power generation unit configured to generate power from an element selected from the group consisting of heat of a surface of a skin, a difference in ion concentration between a body site and another site or a body surface, sweat on the body surface, and combinations thereof:

an authentication unit configured to perform authentication using power generation information from the power generation unit as electric power and comparing the power generation information with predetermined power generation information, wherein the power generation information is selected from the group consisting of a waveform of a voltage, a time interval between multiple waveforms, and combinations thereof; and a memory configured to record the predetermined power generation information.

6. The container system according to claim 5, configured to eject the predetermined object to an outside of the container unit if the authentication is successful.

7. The container system according to claim 5, configured to release the predetermined object to an outside of the container unit if the authentication is successful.

8. The container system according to claim 5, configured to discharge an appropriate amount of the predetermined object if the authentication is successful.

9. The container system according to claim 5, configured to provide information about the predetermined object if the authentication is successful.

10. The authentication method according to claim 5, wherein the authentication comprises:

requesting an ID;

reading a first ID from the memory;

sending an ID signal indicating a second ID;

determining whether the ID signal has been sent; and determining whether the second ID matches the first ID.

11. The authentication method according to claim 5, further comprising:

generating an ID signal in a predetermined format;

determining whether an ID indicated by the ID signal is a desired ID; and recording timing of generating the power generation information by the power generation unit when the ID indicated by the ID signal is the desired ID.

* * * * *